US005539381A

United States Patent [19]

Johnson

[11] Patent Number: 5,539,381

[45] Date of Patent: Jul. 23, 1996

[54] FIXED THRESHOLD AND RATE OF RISE HEAT DETECTOR WITH DYNAMIC THERMAL REFERENCE

[75] Inventor: Kirk R. Johnson, Vancouver, Wash.

[73] Assignee: Sentrol, Inc., Tualatin, Oreg.

[21] Appl. No.: 337,898

[22] Filed: Nov. 14, 1994

[51] Int. Cl.[6] ..... G08B 17/00

[52] U.S. Cl. ..... 340/584; 340/589; 340/587; 340/588; 374/169; 374/10

[58] Field of Search ..... 340/589, 584, 340/587, 588; 374/169, 178, 10, 107, 110, 112

[56] References Cited

U.S. PATENT DOCUMENTS

| | | | |
|---|---|---|---|
| 3,518,654 | 6/1970 | Vassil | 340/589 |
| 3,728,615 | 4/1973 | Hill et al. | 340/589 |
| 4,331,888 | 5/1982 | Yamauchi | 340/589 |
| 5,103,916 | 4/1992 | McLelland | 340/589 |
| 5,254,975 | 10/1993 | Torikoshi | 340/589 |

OTHER PUBLICATIONS

"Description of Sentrol® ESL Model 613ES (613 V S) Fixed Temperature Heat Detector" —Information Disclosure Statement submitted by Applicant on Apr. 4, 1995.

*Primary Examiner*—Brent A. Swarthout
*Assistant Examiner*—Benjamin Lee
*Attorney, Agent, or Firm*—Stoel Rives

[57] ABSTRACT

A heat detector uses a single comparator operating in conjunction with a dynamically changing thermal reference that ensures quick response to rapid rates of thermal change and a fixed threshold that indicates an ambient temperature exceeds a threshold temperature. The inputs of the comparator receive different ones of the output signals of two thermal sensors. One thermal sensor responds nearly instantaneously to changes in ambient thermal conditions. The other thermal sensor is mounted on a printed circuit board operating as a heat sink and responds more slowly to changes in ambient thermal conditions. The difference between the thermal sensor output signals is zero at a lower ambient temperature when the rate of thermal change exceeds a preset amount and at a higher ambient temperature when the rate of thermal change is relatively slow. Thus, the comparator output indicates an alarm condition upon detection of a rapid change in ambient thermal condition or a thermal condition exceeding a threshold, irrespective of the rate of change.

9 Claims, 2 Drawing Sheets

FIXED THRESHOLD AND RATE OF RISE HEAT DETECTOR WITH DYNAMIC THERMAL REFERENCE

TECHNICAL FIELD

This invention relates to heat detectors and, in particular, to an economical fixed threshold and rate of rise heat detector that uses a dynamically changing thermal reference to indicate an ambient temperature exceeding a threshold and to ensure quick response to rapid rates of thermal change.

BACKGROUND OF THE INVENTION

A heat detector monitors the ambient thermal condition in the region where the heat detector is placed. A heat detector can be included as part of a smoke detector or operate as a stand alone device. The heat detector typically has a rate of rise capability that triggers an alarm whenever the ambient temperature change exceeds a predetermined rate and persists for a predetermined time. Certain heat detectors trigger an alarm also whenever the ambient temperature exceeds a fixed threshold, irrespective of the rate of thermal change.

SUMMARY OF THE INVENTION

An object of the invention is to provide a fixed threshold and rate of rise heat detector that is implemented in a relatively simple electrical circuit design and is inexpensive to manufacture.

The present invention is an economical heat detector that has fixed threshold and rate of rise ambient thermal condition detection capabilities.

The heat detector uses a single comparator operating in conjunction with a dynamically changing thermal reference that ensures quick response to thermal changes and a fixed threshold that indicates an ambient temperature exceeds a threshold temperature. The inputs of the comparator receive different ones of the output signals of two thermal sensors. One thermal sensor is a bipolar transistor whose body is mounted away from the electronic printed circuit board ("PCB") to respond nearly instantaneously to changes in ambient thermal conditions. The other thermal sensor is a bipolar transistor mounted on the PCB, which functions as a heat sink, to respond more slowly to changes in ambient thermal conditions. The differential temperature response rate of rise between thermal sensors allows the comparator to indicate an alarm condition in two instances when the thermal sensor output signals cross over, i.e., the difference between them is zero.

The difference between the thermal sensor output signals is zero at a lower ambient temperature when the rate of thermal change exceeds a preset amount and at a higher ambient temperature when the rate of thermal change is relatively slow. Thus, the comparator output indicates an alarm condition upon detection of a rapid change in ambient thermal condition or a thermal condition exceeding a threshold, irrespective of the rate of change.

Each of the thermal sensors forms part of an amplifier subcircuit, and the gain of both subcircuits is variable to set the sensitivity of the thermal sensor in response to a rate of thermal change.

Additional objects and advantages of this invention will be apparent from the following detailed description of a preferred embodiment thereof which proceeds with reference to the accompanying drawings.

DETAILED DESCRIPTION OF PREFERRED EMBODIMENT

Figure 1:
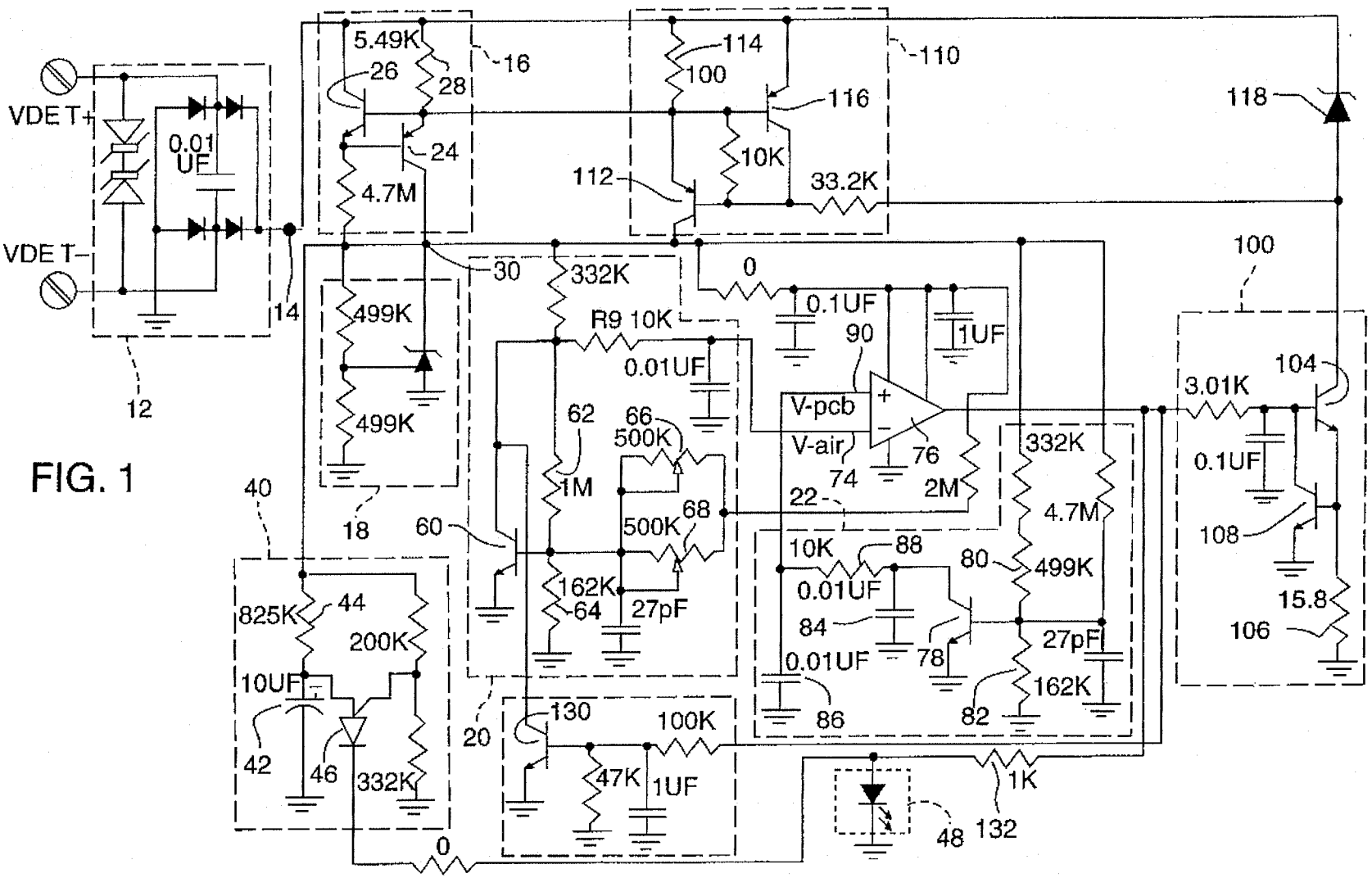
FIG. 1 is an electrical circuit diagram of the fixed threshold and rate of rise heat detector of the present invention.

FIG. 1 is an electrical circuit diagram of a heat detector 10 of the present invention. The electronic components of heat detector 10 are carried on a printed circuit board (PCB). Heat detector 10 has a power supply conditioner 12 that includes a diode network to prevent heat detector 10 from damage resulting from overvoltage or reverse polarity applied voltage conditions. The voltage appearing at output terminal 14 of power supply conditioner 12 ranges from 8.5 to 33 volts DC and is the bias voltage source for the electrically active components of heat detector 10.

A current limiter 16 and a shunt voltage regulator 18 cooperate to provide a current-limited +5 volt bias source for a remote thermal sensor subcircuit 20 and a PCB thermal sensor subcircuit 22, the functions of which will be described below. Current limiter 16 includes bipolar transistors 24 and 26 cross-coupled in a conventional manner to perform a current limiting function. A 5.5 kΩ resistor 28 connected across the emitter-base junction of transistor 26 will cause it to conduct electrical current when the current flowing through resistor 28 reaches 100 microamperes. Because the collector of transistor 26 is connected to the base of transistor 24 and resistor 28 is connected to the emitter of transistor 24, the maximum amount of current flowing through the collector of transistor 24 to voltage regulator 18 is 100 microamperes. Voltage regulator 18 includes a resistive divider network and a voltage regulator device, such as an EC 431 adjustable shunt regulator, available from ECI semiconductor, Santa Clara, Calif., that develops at its output terminal 30 a +5 volt DC signal.

Output terminal 30 is connected to a conventional unijunction transistor oscillator 40 whose oscillation frequency is set to 0.11 Hz by a 10 μf capacitor 42 and an 825 kΩ resistor 44. The 0.11 Hz signal appears at the emitter of a unijunction transistor 46 and drives a light-emitting diode (LED) 48, which flashes at the 0.11 Hz rate to indicate a nominal steady-state operating condition.

Output terminal 30 delivers +5 volts DC to remote thermal sensor subcircuit 20, which includes a heat sensing bipolar transistor 60 of, for example, a 2N5088 type. The electrical terminal leads of transistor 60 are sufficiently long so that its body portion is positioned away from the PCB to sense the temperature of the ambient air and is configured to use the −2.12 mV/°C. temperature dependence characteristic of the base-emitter junction voltage. Transistor 60 is configured as a variable gain amplifier whose voltage preferably changes at −15.1 mV/°C. The gain is set by the ratio of a 1 MΩ resistor 62 and a 162 kΩ resistor 64. Either one of two-500 kΩ potentiometers 66 and 68 (connected as variable resistors) provides an adjustment control to trim the gain set by resistors 62 and 64. (One of potentiometers 66 and 68 is of a surface mount type, and the other is of a through-hole type. Only one of them is actually installed, depending on the circuit board layout chosen.) The collector of transistor 60 provides a thermal output signal, $V_{AIR}$, that is filtered by a low pass filter comprising a 10 kΩ resistor 70 and a 0.01 μf capacitor 72. The junction node between resistor 70 and capacitor 72 is connected to the inverting input 74 of a programmable low power operational amplifier, such as a TLC271, functioning as a comparator 76.

Output terminal 30 also delivers +5 volts DC to PCB thermal sensor subcircuit 22, which includes a heat sensing bipolar transistor 78 of, for example, a MMBT5088 type. The body portion of transistor 78 is surface mounted on the PCB, which functions as a heat sink, to sense the thermal characteristics of the ambient air in similar manner to that of transistor 60, subject to the heat absorption by the PCB. Transistor 78 is configured as a fixed gain amplifier whose output voltage preferably changes at −8.6 mV/°C. The gain is set by the ratio of a 499 kΩ resistor R80 and a 162 kΩ resistor 82. The material from which the PCB is fabricated is CHEM 1, but virtually any printed circuit board material can produce the thermal lag required that, together with the gain set by resistors 62 and 64, provides transistor 78 with the desired output characteristics.

The collector of transistor 78 provides a thermal reference output signal, $V_{PCB}$, that is filtered by a π-type low pass filter comprising two 0.01 μf capacitors 84 and 86 and a 10 kΩ resistor 88. The junction node between capacitor 86 and resistor 88 is connected to the noninverting input 90 of comparator 76. The thermal gain equations for "AIR" heat sensing transistor 60 and "PCB" heat sensing transistor 78 are expressed as follows:

AIR SENSING TRANSISTOR 60:

$$\left\{ \frac{R_{62}}{R_{64}} + 1 \right\} \{-2.1 \times 10^{-3}\} = -0.0151$$

*PCB* SENSING TRANSISTOR 62:

$$\left\{ \frac{R_{80}}{R_{82}} + 1 \right\} \{-2.1 \times 10^{-3}\} = -0.0086.$$

The quantities $R_{62}$, $R_{64}$, $R_{80}$, and $R_{82}$ represent resistors 62, 64, 80, and 82, respectively.

Figure 2A:
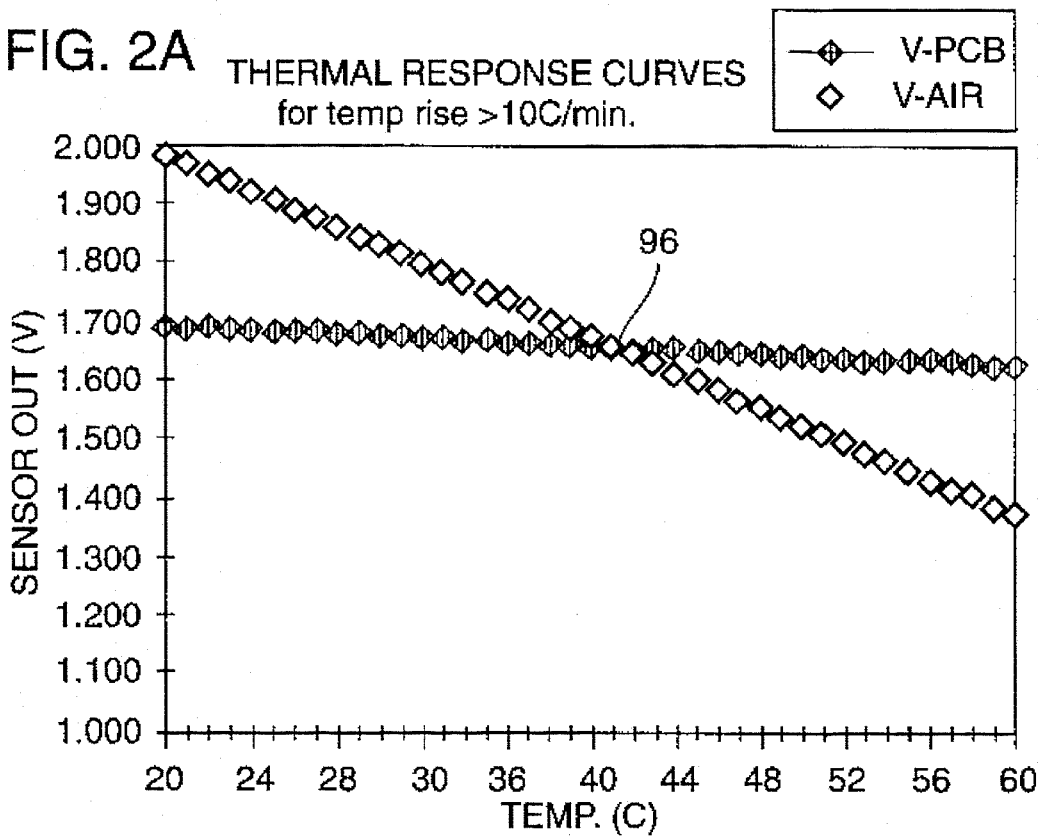
FIGS. 2A and 2B are thermal response curves showing the thermal sensor output signal crossover points that would indicate an alarm condition for, respectively, a relatively rapid rate of thermal change and a relatively slow rate of thermal change.
Figure 2B:
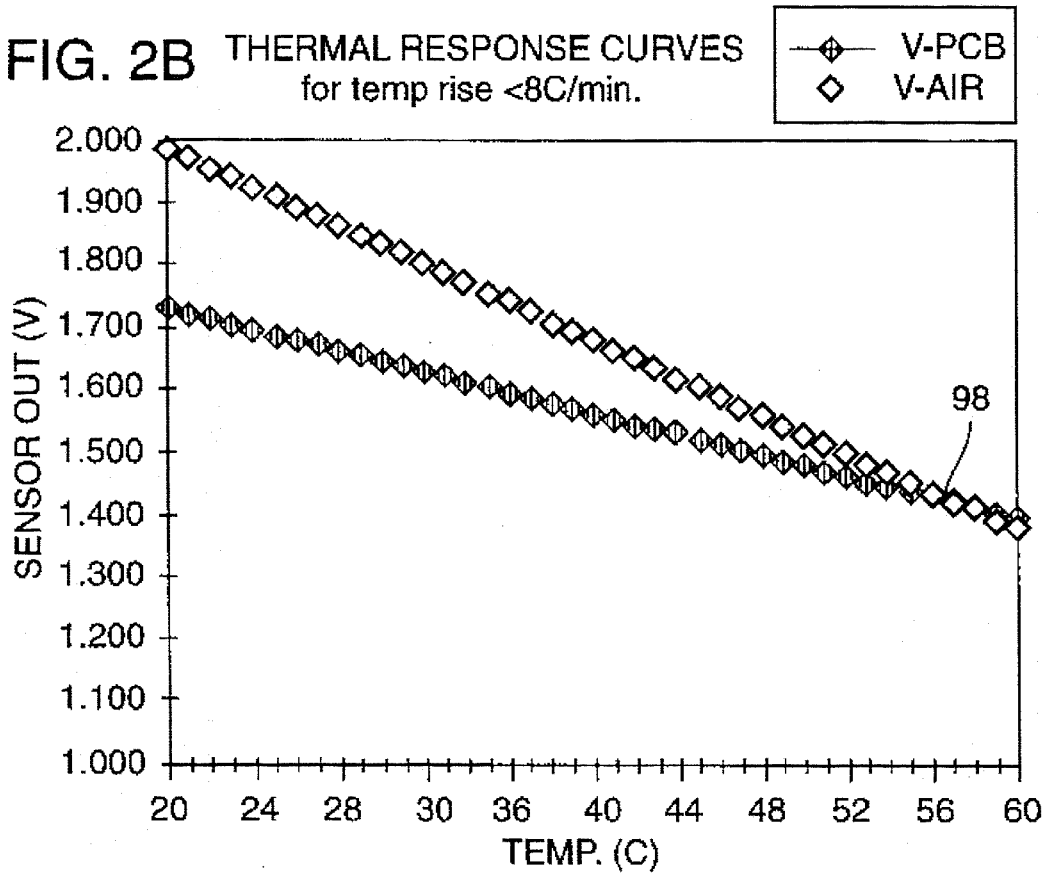

FIGS. 2A and 2B show two sets of thermal response curves for the thermal output signal, $V_{AIR}$, and thermal reference output signal, $V_{PCB}$. FIG. 2A presents the thermal response curves for a rapid rate of ambient temperature rise (>10° C./min), and FIG. 2B presents the thermal response curves for a slow rate of ambient temperature rise (<8° C./min).

With reference to FIG. 2A, at a 10° C./min rise in ambient temperature, $V_{PCB}$ is nearly constant at 1.7 volts over the 20° C. to 60° C. temperature range but the $V_{AIR}$ signal decreases linearly by 0.6 volt from 2.0 volts to 1.4 volts over the same temperature range. $V_{PCB}$ is nearly constant because the heat sink has had insufficient time to absorb the rapidly increasing amount of heat; therefore, heat sensing transistor 78 does not respond to the rapidly changing ambient temperature. $V_{AIR}$ changes significantly because heat sensing transistor 60 is positioned to respond to the ambient temperature, which is changing rapidly in the situation presented. The $V_{PCB}$ and $V_{AIR}$ signals are equal at a crossover point 96 that represents a 40° C. temperature and a 1.7 volt sensor output.

With reference to FIG. 2B, at a 8° C./min rise in ambient temperature, the $V_{PCB}$ signal decreases linearly by 0.35 volt over the 20° C. to 60° C. temperature range. The $V_{AIR}$ signal decreases linearly with a greater slope than that of the $V_{PCB}$ signal and by 0.6 volt over the same temperature range. The $V_{PCB}$ signal decreases with increasing temperature because the slow rate of ambient temperature change permits the heat sink to warm up and thereby absorb the heat that causes heat sensing transistor 78 to respond. The $V_{AIR}$ signal changes significantly because it responds virtually instantaneously to the ambient temperature. The $V_{PCB}$ and $V_{AIR}$ signals are equal at a crossover point 98 that represents a 57° C. temperature and a 1.4 volt sensor output.

Whenever the difference between the $V_{PCB}$ and $V_{AIR}$ signals is zero at crossover point 96 or at crossover point 98, the output of comparator 76 switches from zero to +5 volts to indicate an alarm condition.

Skilled persons will appreciate that if the gains of the transistor amplifiers in thermal sensor subcircuits 20 and 22 are equal, the circuit described above can be modified to carry out only a rate of rise heat detection. Variable resistor 68 can be used to calibrate heat detector 10 by setting the appropriate difference between the $V_{PCB}$ and $V_{AIR}$ signals at a known ambient temperature.

With reference again to FIG. 1, the change from 0 to +5 volts at the output of comparator 76 causes an alarm output driver 100 to sound an alarm and a latch 102 to maintain the alarm condition until it ceases and until heat detector 10 is reset for nominal operation. Reset is accomplished by removal and re-application of electrical power to heat detector 10.

Alarm output driver 100 includes a drive transistor 104 that conducts electrical current through its emitter to a resistive alarm load 106 of about 15.8 Ω when the output of comparator 76 indicates an alarm condition. Resistive load 106 is connected across the base-emitter junction of a transistor 108 whose collector is connected to the base of drive transistor 104 to limit to about 41 milliamperes the current flowing to the alarm load. The collector of drive transistor 104 is connected to a bypass current circuit 110 that provides additional current to drive LED 48 and provide bias current for transistor 104 during an alarm condition. During an alarm condition, circuit 110 bypasses the normal 100 microampere current limit produced by current limiter 16 to drive LED 48 and transistor 104 with sufficient current.

Current bypass 110 includes a transistor 112 whose base receives electrical current flowing from the collector of transistor 104. Whenever the collector current of transistor 104 causes the emitter current of transistor 112 to exceed 6.5 milliamperes, the voltage developed across a 100 Ω resistor 114 develops about 0.65 volt across the base-emitter junction of a transistor 116, whose collector is connected to the base of transistor 112 and thereby limits to 6.5 milliamperes the current flowing to the nonalarm output driver circuitry of heat detector 10 as alarm output driver 100 activates the alarm.

A 5.6 volt Zener diode 118 is connected between output terminal 14 of power supply conditioner 12 and the collector of drive transistor 104 of alarm output driver 100 to ensure that in an alarm condition at least 5.6 volts appear at output terminal 14.

Latch 102 receives the +5 volt signal appearing at the output of comparator 76 and causes a transistor 130 whose emitter is connected to ground and collector is connected to the collector of transistor 60 to conduct electrical current and thereby cause the $V_{AIR}$ signal to be about zero volts. This condition causes the $V_{PCB}$ signal always to exceed the $V_{AIR}$ signal and thereby produces a latched continuous alarm condition. The output of comparator 76 is also connected through a 1 kΩ resistor 132 that is connected to LED 48, which is continuously illuminated during a latched alarm condition.

It will be obvious to those having skill in the art that many changes may be made to the details of the above-described embodiment of this invention without departing from the underlying principles thereof. The scope of the present invention should, therefore, be determined only by the following claims.

I claim:

1. A rate of rise heat detector with a dynamic reference, comprising:

a comparator having signal and reference inputs and an output changing between first and second output states in response to differences in values of signals applied to the signal and reference inputs, the first output state indicating an alarm condition and the second output state indicating a no alarm condition;

a first thermal sensor subcircuit applying to the comparator signal input a thermal output signal whose value changes at a first thermal response rate in response to changes in ambient temperature, the first thermal response rate having a magnitude; and a second thermal sensor subcircuit applying to the comparator reference input a dynamic thermal reference output signal whose value changes at a second thermal response rate in response to changes in ambient temperature, the second thermal response rate having a magnitude and the first and second thermal response rates being different from each other such that for a higher temperature rise rate and a lower temperature rise rate there are respective first and second crossover points at which the values of the thermal and reference output signals are equal at different respective temperature values on a plot of sensor output versus ambient temperature, the magnitude of the first thermal response rate exceeding that of the second thermal response rate such that a rapid increase in ambient temperature corresponding to the higher temperature rise rate causes the difference between the thermal output signal and the reference output signal to change quickly in response to the ambient temperature change to reach the first crossover point and thereby produce a comparator output signal in the first output state to indicate an extreme heat increase alarm condition and such that a slow increase in ambient temperature corresponding to the lower temperature rise rate causes the difference between the thermal output signal and the reference output signal to change slowly in response to the ambient temperature change to reach the second crossover point and thereby produce a comparator output signal in the first output state to indicate a gradual heat increase alarm condition.

2. The heat detector of claim 1 in which the first thermal sensor subcircuit includes a thermal sensor positioned to sense a rate of change in ambient temperature and the second thermal sensor subcircuit includes a thermal sensor in association with a heat sink to sense at an attenuated rate the change in ambient temperature.

3. The heat detector of claim 2 in which the heat sink comprises a printed circuit board onto which the thermal sensor of the second thermal sensor subcircuit is mounted.

4. The heat detector of claim 1 in which the first thermal sensor subcircuit includes a heat-sensitive transistor amplifier that produces an output signal whose value changes at the first thermal response rate.

5. The heat detector of claim 4 in which the heat-sensitive transistor amplifier includes a transistor of a bipolar type and the output signal value changes as a function of the junction temperature of the transistor.

6. The heat detector of claim 4 in which the heat-sensitive transistor amplifier has a selectable gain that sets the first thermal response rate.

7. The heat detector of claim 1 in which the second thermal sensor subcircuit includes a heat-sensitive transistor positioned on a heat sink and operating as an amplifier to sense at an attenuated rate of response the rate of change in ambient temperature.

8. The heat detector of claim 7 in which the heat sink comprises a printed circuit board.

9. The heat detector of claim 1 in which the difference between the values of the thermal and reference output signals is zero at a lower ambient temperature for a more rapid rate of change in ambient temperature than that for a less rapid rate of change in ambient temperature.

* * * * *